428-408 SR
5/11/76 OR 3,956,568

United States Patent [19]
Kanemaru et al.
[11] 3,956,568
[45] May 11, 1976

[54] CARBON-METAL COMPOSITE MATERIAL

[75] Inventors: Toyonosuke Kanemaru, Zushi; Hiroshi Yamazoe, Tokyo; Hiroshi Ichikawa, Yokohama, all of Japan

[73] Assignee: Nippon Carbon Co. Ltd., Tokyo, Japan

[22] Filed: Mar. 6, 1974

[21] Appl. No.: 448,471

[30] Foreign Application Priority Data

Mar. 12, 1973 Japan ..... 48-28058

[52] U.S. Cl. ..... 428/408; 428/457
[51] Int. Cl.[2] ..... B32B 9/00
[58] Field of Search ..... 117/160 A, 160 R, 228, 117/169; 428/408, 532, 457

[56] References Cited

UNITED STATES PATENTS 2,983,034 5/1961 Humenik et al. ..... 117/228
3,756,911 9/1973 Kanemaru ..... 117/160 R
3,770,488 11/1973 Pepper et al. ..... 117/228

*Primary Examiner*—Mayer Weinblatt
*Assistant Examiner*—Edith R. Buffalow
*Attorney, Agent, or Firm*—Frank J. Jordan

[57] ABSTRACT

A process for the preparation of a carbon-metal composite material for mechanical sliding members, comprising impregnating a carbon substrate with an alloy comprising copper, nickel or a copper-nickel as a base metal and at least one of titanium, zirconium and silicon as a wetting agent for the carbon. In one embodiment, the alloy further comprises at least one of a third component such as tin, antimony, zinc, manganese, iron, chromium, lead, magnesium and phosphorus.

16 Claims, 1 Drawing Figure

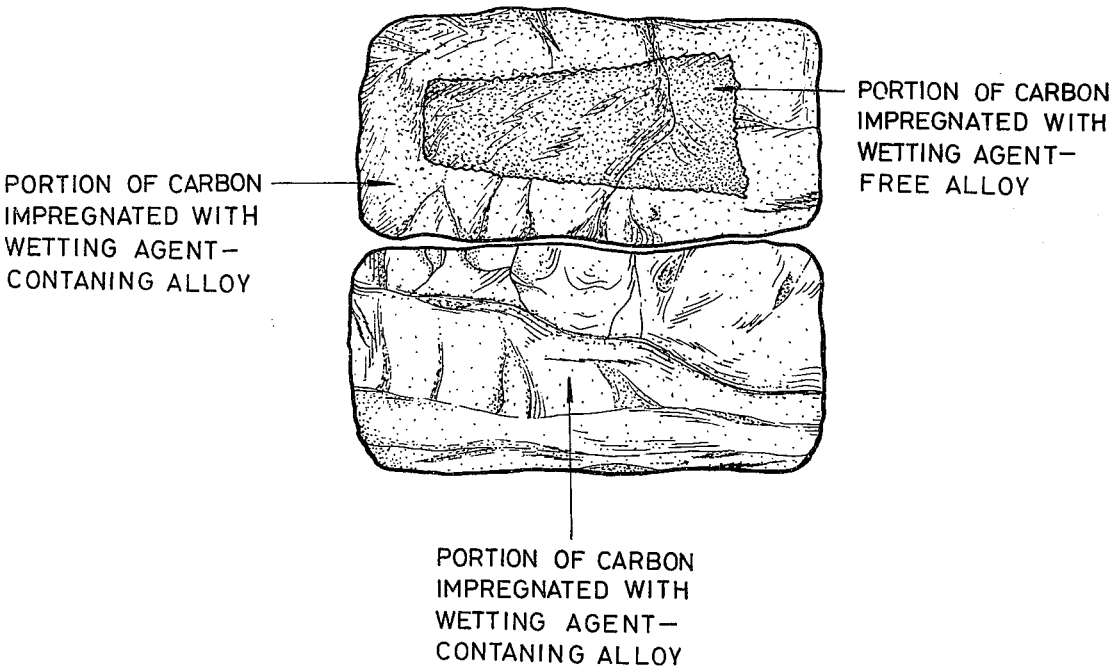
PORTION OF CARBON IMPREGNATED WITH WETTING AGENT-FREE ALLOY
PORTION OF CARBON IMPREGNATED WITH WETTING AGENT-CONTANING ALLOY
PORTION OF CARBON IMPREGNATED WITH WETTING AGENT-CONTANING ALLOY

CARBON-METAL COMPOSITE MATERIAL

This invention relates to a carbon-metal composite material for mechanical sliding members and more particularly relates to a carbon-metal composite material for mechanical sliding members which has excellent mechanical strength and wear resistance even at high temperatures of not lower than 400°C and is composed of a carbon substrate and at least one high melting metal combined therewith.

Carbon-metal composite sliding member materials which are provided with excellent self-lubrication characteristic of carbon and with high mechanical strength characteristic of a metal, have been in practical use as a material for apex seals for rotary piston engines, vanes for various compressors and pumps, and bearings for rotatable mechanical members.

On the other hand, there has recently been a tendency that a mating mechanical member, particularly a rotary piston engine, in sliding contact with which the sliding member moves is operated at higher temperatures than before in order to enhance its performance or effectiveness. However, not only composite materials which are made of carbon and any one of lead, tin and zinc and their alloys and which are now in use for sliding members of general machines, but also even composite materials which are made of carbon and any one of antimony and aluminum and their alloys and which are used under severer conditions, are being inadaptable for use at temperatures exceedng 300°–400°C since they are disadvantageous in that they decrease in mechanical strength, wear resistance and corrosion resistance and are liable to cause seizure at such high temperatures.

Attempts have been made by the present inventors to find a material for sliding members (the material being hereinafter referred to as "sliding member material") which is successfully used in such high-temperature atmosphere as mentioned above and, as a result, they have found that a satisfactory heat-resistant carbon-metal composite sliding member material is prepared by incorporating copper or nickel as a base metal with titanium, zirconium or silicon as a wetting material and further with tin, antimony, manganese, magnesium, zinc, phosphorus or the like to form an alloy having a melting point of 600° – 1400°C which is melted and then impregnated into a carbon substrate such as a non-graphitic or graphitic carbon substrate, in a block or powder form, thus accomplishing this invention.

The most important feature of this invention is the use of at least one of tin, zinc and silicon as the wetting agent which enhances the strength of a bond effected between the carbon substrate and the metal impregnated thereinto. Such wetting agents as mentioned above are hereinafter referred to simply as "wetting agent" for brevity. Non-graphic carbon material and graphic carbon material (these carbon materials being hereinafter collectively referred to simply as "carbon") are difficult to get wetted with a metal and, for this reason, they have heretofore been used as a material for crucibles in which a metal is melted for casting. Even if a carbon substrate is impregnated with copper, nickel or their alloys simply because of the metals being satisfactory in heat resistance, the carbon-metal composite material so obtained will not have a satisfactory strength because of unsatisfactory wetting of the carbon with the metal.

On the other hand, if aluminum (Al) which is satisfactorily wettable with carbon is melt impregnated into a carbon substrate at high temperatures, it will produce remarkable amounts of aluminum carbide which is chemically active, whereby disadvantageously the resulting carbon-metal composite material is subject to the effects of moisture and the like and is therefore degraded in corrosion resistance. Iron (Fe) and its alloys having a high temperature melting point are very difficult, or rather practically impossible to form a carbon-metal composite material with carbon on an industrial scale by the use of a pressure melt-impregnating method.

Titanium, zirconium or silicon incorporated in a copper or nickel base metal not only functions as a wetting agent for carbon but forms a corresponding carbide with the carbon in the interface between the wetting agent-incorporated metal and the particulate carbon when the former is impregnated into the latter at high temperatures of not lower than about 700°C, thereby producing a carbon-metal composite material having an increased high-temperature strength together with an enhanced wear resistance. Unlike the carbide $Al_4C_3$, however, the carbide TiC, ZrC or SiC is chemically stable whereby the resulting carbon-metal composite material is not deteriorated at all in corrosion resistance.

Nevertheless, carbon-metal composite materials which are prepared by simply pressure melt impregnating a copper or nickel alloy containing titanium, zirconium or silicon as the wetting agent for carbon into carbon blocks or powder may very often consist of the surface (or exterior) and interior portions which are different in composition and characteristics from each other as is shown in the accompanying drawing. The reason why these two heterogeneous portions are formed is that when the alloy in a molten state is impregnated into the carbon in a block or powder form, the wetting agent such as the titanium, zirconium or silicon is preferentially wetted and combined with the carbon while converting part of the wetting agent-combined carbon to the corresponding carbide at a temperature not lower than 700°C, whereby it is all consumed before arrival at the interior portion of the carbon thus impregnating said interior portion only with the wetting agent-free metal. The interior portion of the carbon is accordingly low in mechanical strength at ambient and high temperatures and is liable to cause the irregularity of impregnation therein due to the unsatisfactory filling thereof with the impregnating metal.

Attempts have been made by the present inventors to obtain carbon-metal composite materials having satisfactory characteristics without causing such heterogeneity as above in the composite materials so obtained, with the result of the following conditions being found to be necessary to this end.

The amount of titanium, zirconium or silicon contained as the wetting agent in alloys which may be used in this invention varies depending upon the composition of other metallic elements than the wetting agent in the alloys, and it is in the range of approximately 0.5 – 25% by weight, preferably 5 – 16% by weight based on the alloy. The use of the wetting agent in amounts of less than 0.5% by weight will exhibit no substantial effects of this invention and will create remarkable heterogeneity in a carbon-metal composite material to be obtained, while the use thereof in amounts of more than 25% by weight will cause the segregation of the titanium, zirconium or silicon thereby deteriorating the homogeneity of a product to be obtained although the larger the amount of the wetting agent used is, the less the degree of the heterogeneity caused is. In the latter case a third component such as tin, antimony, zinc or manganese must also be added in large amounts to prevent the resulting product from having an unduly high melting point, thereby making the product brittle.

The compositions of the alloys as well as other conditions which may be used in the preparation of a composite material of this invention, are as follows.

| | |
|---|---|
| Wetting agent | Ti, Zr or Si: 0.5 – 25 wt.%, preferably 5 – 16 wt.% |
| Base metal | As single metal or alloy which is excellent in heat and corrosion resistances, Cu, Ni or Cu-Ni: not less than 40 wt.%, preferably not less than 50 wt.% |
| If necessary, A third component | At least one of Sn, Sb, Zn and Mn: 3 – 45 wt.%, preferably 5 – 35 wt.% |
| If further necessary, | At least one of Fe, Cr, Pb, Mg and P: 1 – 15 wt.% |
| Melting point of alloy: | 600° – 1200°C, preferably 700 – 1000°C. |
| Temperature of impregnation: | 700 – 1400°C |
| Time of impregnation: | 1 – 60 minutes, preferably 3 – 30 minutes. |

The impregnation of the carbon substrate with the alloy is effected in a high pressure-proof vessel by the use of a usual known process. The impregnating temperature should preferably be approximately 50°–200°C higher than the melting point of the alloy used. However, the use of higher impregnating temperatures in the impregnation of the carbon particularly in the form of a block will cause a more remarkable heterogeneity or segregation in the resulting product and, therefore, an impregnating temperature of 700°– 900°C is preferable for such carbon blocks. The pressure-proof vessel was charged with the carbon substrate and the alloy in such a manner that they are positioned separately from each other in the vessel, thereafter purged with an inert gas such as nitrogen, helium or argon and then raised in temperature to the extent that the interior of the vessel reaches a desired impregnating temperature. The vessel is further decreased in pressure as required. Particularly in the case of the use of the carbon block for impregnation, a reduced pressure is required and a reduced pressure of not higher than 1 mm Hg is preferable. The carbon substrate is immersed in the alloy in the molten state and then kept immersed therein under a pressure of at least 20 Kg/cm$^2$, preferably 50 – 200 Kg/cm$^2$, exerted by an inert gas introduced thereinto and for 1 – 60 minutes, preferably 3 – 30 minutes, after which the carbon substrate so impregnated was withdrawn from the molten alloy, cooled and then taken out of the vessel.

In the selection of the base metal or metal substrate, it is required that the base metal substrate selected should have a melting point within the aforementioned range and a satisfactory lubricating property. In addition, the addition of the third component will have the following effects.

Lowering of melting point — Sn, Sb, Zn, Mn, Mg, P
Increase of high-temperature strength — Sn, Fe, Cr
Increase of wear resistance — Sn, Mn, Fe, Cr
Improvement of lubricating property — Sn, Pb
Purification of metal — Zn, Mg, P The carbide formation of the aforementioned wetting agent will be effective in obtaining a product having an increased high-temperature strength and wear resistance.

In the course of impregnation under said impregnating conditions, the wetting agent combines with the carbon substrate and about 10 – 60% by weight of the wetting agent forms a corresponding carbide with the carbon substrate. The amount of carbide formed can be controlled by the previous selection of carbon substrate, composition of an alloy and impregnating conditions. The most preferable amounts of the carbide formed are attained by reacting 25 – 50% by weight of the wetting agent with the carbon substrate to form the corresponding carbide.

Carbon materials for carbon substrates which may be used in this invention include coal, pitch coke, artificial graphite, carbon black, thermocracked graphite and vitreous carbon, among which coal and pitch coke are excellent in providing the resulting product with wear resistance. Carbon blocks are usually prepared by shaping powdered carbon material into desired shapes, if desired, after incorporated with a carbonizable binder, and then baking the shaped carbon bodies at temperature of not less than 1000°C, preferably 1200° – 1400°C. The carbon material may be 15 – 105 $\mu$, preferably not larger than 74 $\mu$ in particle size, and the heterogeneity created in a product to be obtained will be less remarkable with the increase of the carbon material in minimum particle size.

In cases where carbon blocks or baked carbon bodies are used as a starting carbon substrate for impregnation in the practice of this invention, they should have a porosity of 10 – 60%, preferably 25 – 45%. The higher the porosity is, the less the heterogeneity is created in the resulting product.

When carbon blocks or powder in which titanium, zirconium or silicon powder is previously incorporated and dispersed, are used as a starting carbon substrate in the impregnation process according to this invention, the heterogeneity will not be created in a product to be obtained and, in addition, the wetting agent-incorporated carbon substrate will permit the use, as the impregnant, of a copper or nickel alloy containing the wetting agent in only small amounts. It is desirable that the wetting agent be previously incorporated in the carbon blocks or powder in amounts of 5 – 30% by weight based on the carbon. The use of the wetting agent in amounts of less than 5% by weight will allow the heterogeneity to be created in a product to be obtained, while the use thereof in amounts of more than 30% by weight will deteriorate the resulting product in sliding characteristics. The wetting agent to be incorporated should preferably have a particle size of 74 $\mu$ or finer.

In a process for the preparation of the sliding member material of this invention, the impregnating alloy is used in amounts of 10 – 60% by volume, preferably 25 – 45% by volume, with the balance (90 – 40% by volume) being for the starting carbon substrate. The use of the alloy in amounts of less than 10% by volume will not give a product having satisfactory strength, while the use thereof in amounts of more than 60% by volume will give a product having a decreased water resistance and degraded sliding characteristics such as an increased coefficient of friction.

This invention will be detailed hereinbelow by reference to examples in which all the parts and percentages are by weight unless otherwise specified.

EXAMPLE 1

One hundred parts of coal pitch coke pulverized to particles of 74 $\mu$ or finer in particle size were incorporated with 30 parts of coal pitch as a binder to form a mixture which was kneaded at about 150°C for one hour, cooled and again pulverized to particles having a 105-$\mu$ or finer particle size. The particles so obtained were compressed under a pressure of 1 t/cm² to shapes each having a size of 100 × 100 × 30 mm which were then heated to 1300°C at a temperature-raising rate of 10°C/hr in a baking furnace thereby obtaining carbon substrates.

Separately, there was prepared an alloy having a melting point of 700°C which comprised 4% of Ti, 2% of Mn, 20% of Sb and the balance consisting of Cu and incidental impurities.

The carbon substrate so obtained and the impregnating alloy so prepared were charged into an autoclave where the carbon substrate was freed of the air present in the pores thereof under a vacuum of 0.1 mm Hg, thereafter immersed in the alloy in a molten state at 800°C and then impregnated with the molten alloy in an atmosphere of a high-pressure argon gas at a pressure of 100 Kg/cm² for 15 minutes thereby to obtain a carbon-metal composite material having the strength, hardness, wear resistance and the like indicated in Table 1. The carbide formed in the product contained 27% by weight of the titanium used.

EXAMPLE 2

The same carbon substrate as used in Example 1 was pressure impregnated with an alloy in a molten state at 950°C in the same manner as in Example 1 to obtain a carbon-metal composite material. The aforementioned alloy originally had a melting point of 720°C and comprised 1% of Ti, 8% of P, 5% of Sn and the balance consisting of Cu and incidental impurities. The properties of the composite material so obtained are indicated in Table 1. The carbide formed in the product contained 35% of the titanium used.

EXAMPLE 3

An alloy having a melting point of 950°C which comprised 16% of Ti, 20% of Sn and the balance consisting of Cu and incidental impurites, in a molten state at 1000°C, was pressure impregnated into the same carbon substrate as used in Example 1 to obtain a carbon-metal composite material which was then tested for its properties. The test results are shown in Table 1. The carbide formed in the product contained 50% of the titanium used.

EXAMPLE 4

Bituminous coal comprising 42% of volatile matter, 1% of moisture, 5% of ashes and the balance consisting of fixed carbon was pulverized to produce particles of not larger than 74 $\mu$ in particle size which were then compressed under a pressure of 3 t/cm² to form a shaped body thereof having a size of 100 × 100 × 30 mm. The shaped body so formed was heated to 1350°C at a temperature-raising rate of 5°C/hr under a stream of nitrogen gas in a baking furnace thereby obtaining a carbon substrate which was then pressure impregnated with an alloy (melting point: 1200°C) which comprised 9% of Zr, 8% of Sn, 5% of Mn and the balance Ni, in a molten in the state at 1300°C thus obtaining a carbon-metal composite material the properties of which are shown in Table 1.

EXAMPLE 5

Coke powder having a 74–$\mu$ or finer particle size prepared by calcination at 1200°C was charged in an iron-made can having a size of 100 × 100 × 50 mm and then pressure impregnated in the same manner as in Example 1, with an alloy (melting point: 850°C) in a molten state at 1000°C comprising 7% of Ti, 15% of Zn, 13% of Sb and the balance Cu thereby to obtain a carbon-metal composite material the properties of which are shown in Table 1.

EXAMPLE 6

The same carbon substrate as prepared in Example 1 was pressure impregnated in the same manner as in Example 1, with an alloy (m.p.: 800°C) in a molten state at 1000°C comprising 15% of Si, 10% of Sn and the balance Cu thereby to obtain a carbon-metal composite material. The properties thereof are shown in Table 1.

EXAMPLE 7

Bituminous coal comprising 42% of volatile matter, 1% of moisture, 5% of ashes and the balance fixed carbon was heated to 1200°C thereby to produce coal coke which was pulverized to particles of not larger than 74 $\mu$ in particle size.

The coal coke powder was charged in an iron-made can having a size of 100 × 100 × 50 mm and then pressure impregnated in the same manner as in Example 1, with an alloy (m.p.: 850°C) comprising 7% Ti, 30% Sn and the balance Cu and being in a molten state at 900°C thereby to obtain a carbon-metal composite material. The properties thereof are described in Table 1.

EXAMPLE 8

The same carbon substrate as prepared in Example 1 was pressure impregnated with an alloy (m.p.: 900°C) in a molten state at 1000°C comprising 10% of Ti, 20% of Sn, 30% of Ni and 40% of Cu, thereby obtaining a carbon-metal composite material the properties of which are shown in Table 1.

EXAMPLE 9

Anthracite powder having a particle size of not larger than 44 $\mu$ obtained by calcination at 1300°C, was incorporated with 5% by weight of Ti powder having a particle size of not larger than 44 $\mu$, and the whole mass was mixed together by the use of a ball mill to disperse the Ti powder uniformly throughout the anthracite powder. The resulting mixture was charged in an iron-made can and then pressure impregnated with an alloy (m.p.: 950°C) in a molten state at 1000°C comprising 5% of Ti, 15% of Sn and the balance Cu to produce a carbon-metal composite material the properties of which are shown in Table 1.

EXAMPLE 10

The same mixture of anthracite and Ti powders as used in Example 9 was pressure impregnated with an alloy (m.p.: 950°C) in a molten state at 1000°C comprising 0.5% Ti, 15% Sn and the balance Cu to obtain a carbon-metal composite material having the properties shown in Table 1.

EXAMPLE 11

Coal pitch coke powder having a particle size of not larger than 74 $\mu$ was mixed with 10% by weight of Ti powder, and the whole mass was blended by the use of a ball mill to form a uniform mixture. One hundred parts of the uniform mixture so obtained were incorporated with 30 parts of coal pitch as a binder to form a mixture which was kneaded at about 150°C for 1 hour, cooled and then pulverized to produce powder of not larger than 105 $\mu$ in particle size. The powder so produced was formed at a pressure of 1 t/cm$^2$ to a shape having a size of 100 × 100 × 30 mm which was heated to 1100°C at a temperature-raising rate of 10°C/hr in a reducing atmosphere in a baking furnace, thereby to obtain a carbon-titanium baked substrate. The baked substrate so obtained was pressure impregnated with an alloy (m.p.: 920°C) in a molten state comprising 3% of Ti, 5% of Mn, 17% of Sn and the balance Cu, thereby obtaining a carbon-metal composite material the properties of which are indicated in Table 1.

In order to further clarify the characteristics of the carbon-metal composite materials of this invention, comparative and conventional examples will be indicated below.

COMPARATIVE EXAMPLE 1

The procedure of Example 2 was followed except that there was used as the impregnant an alloy (m.p.: 720°C) comprising 8% of P, 5% of Sn and the balance Cu but not comprising Ti.

COMPARATIVE EXAMPLE 2

The procedure of Example 3 was followed except that there was used an alloy (m.p.: 900°C) in a molten state at 1350°C comprising 20% of Sn, 27% of Ti and the balance Cu, thereby to obtain a carbon-metal composite material which was clearly found to have a mottled surface.

CONVENTIONAL EXAMPLE 1

The same carbon substrate as used in Example 1 was impregnated with an alloy (m.p.: 580°C) in a molten state at 700°C comprising 12% of Si, 2% of Ni and the balance Al.

CONVENTIONAL EXAMPLE 2

In the same manner as in Example 1, the same carbon substrate as used in Example 1 was impregnated with an alloy (m.p.: 950°C) in a molten state at 900°C comprising 10% Pb and the balance Cu.

The properties of the carbon-metal composite materials obtained in the aforesaid Comparative and Conventional examples are shown in Table 1.

As regards the tests for properties of these composite materials, bending strength was measured at 450°C in an atmosphere of $N_2$ gas by the use of the Autograph IS-5000 provided with the accessory units for measuring high-temperature strength produced by Shimazu Seisakusho Co., Ltd., Japan; and sliding properties were measured by the use of a constant speed type wear tester under the conditions that the samples having a size of 10 × 20 × 5 mm were caused to be in sliding contact at a load of 1.5 Kg/cm$^2$ with a rotating disk of FC-25 rotating at a peripheral speed of 76 Km/hr, while a motor oil 10W-80W was dropwise supplied to the sliding portions at a supplying rate of 1 cc/hr, the water test being incessantly continued for 8 hours to find the wear loss of the samples in the height direction thereof.

Table 1

| | Starting Carbon Substrate Bulk Density | Properties of Carbon-Metal Composite Material | | | | | |
|---|---|---|---|---|---|---|---|
| | | Metal/Carbon vol. ratio | Bulk density | Shore hardness | Bending strength at ambient temp. (Kg/cm$^2$) | Bending strength at high temp. (Kg/cm$^2$) | Wear loss ($\mu$) |
| Example 1 | 1.65 | 20/80 | 3.6 | 101 | 2100 | 1400 | 6 |
| Example 2 | 1.75 | 15/85 | 3.3 | 103 | 2250 | 1500 | 5 |
| Example 3 | 1.55 | 25/75 | 3.6 | 102 | 2700 | 2100 | 3 |
| Example 4 | 1.10 | 30/70 | 3.5 | 105 | 2950 | 2300 | 2 |
| Example 5 | — | 40/60 | 3.4 | 100 | 2300 | 1600 | 4 |
| Example 6 | 1.45 | 30/70 | 3.5 | 100 | 2200 | 1500 | 4 |
| Example 7 | — | 35/65 | 4.0 | 102 | 2800 | 2200 | 2 |
| Example 8 | 1.55 | 25/75 | 3.6 | 103 | 2400 | 1900 | 5 |
| Example 9 | — | 37/63 | 4.2 | 100 | 3000 | 2400 | 3 |
| Example 10 | — | 37/63 | 4.3 | 98 | 2200 | 1800 | 4 |
| Example 11 | 1.68 | 30/70 | 3.8 | 100 | 2500 | 2100 | 4 |
| Conventional | | | | | | | |
| example 1 | 1.55 | 25/75 | 2.1 | 95 | 1900 | 1000 | 12 |
| example 2 | 1.45 | 30/70 | 3.8 | 100 | 1200 | 500 | 9 |
| Comparative | | | | | | | |
| example 1 | 1.55 | 25/75 | 3.6 | 103 | 1350 | 750 | 8 |
| example 2 | 1.65 | 20/80 | 3.2 | 110 | 1200 | 1000 | 6 |

What is claimed is:

1. A process for the preparation of a carbon-metal composite material for sliding members, comprising impregnating carbon with an alloy consisting essentially of a metal selected from the group consisting of copper, nickel and copper-nickel alloys as a base metal and at least one member selected from the group consisting of titanium and zirconium as a wetting agent for the carbon.

2. A process according to claim 1, wherein the carbon is a carbon block prepared by forming carbon powder together with a binder for said powder, to a desired shape which is then baked at temperatures of not lower than 1000°C.

3. A process according to claim 1, wherein the carbon is selected from the group consisting of coke powder and coal powder.

4. A process according to claim 1, wherein the alloy is used in amounts of 10 – 60% by volume and the carbon in amounts of 90 – 40% by volume.

5. A process according to claim 1, wherein the alloy contains at least one wetting agent in the amounts of 0.5 – 25% by weight.

6. A process according to claim 4, wherein the alloy contains at least one third component in the amounts of 3 – 45% by weight.

7. A process according to claim 5, wherein the alloy contains at least one additional third component in the amounts of 1 – 15% by weight.

8. A process according to claim 1, wherein the alloy has a melting point of 600° – 1200°C.

9. A process according to claim 2, wherein the carbon powder has a particle size of 15 – 105 $\mu$.

10. A process according to claim 2, wherein the carbon shapes have a porosity of 10 – 60%.

11. A process according to claim 1, wherein the impregnation is effected at not lower than 700°C.

12. A process according to claim 1, wherein the impregnating time is between 1 and 60 minutes.

13. A process according to claim 1, wherein the carbon is previously incorporated with the wetting agent in amounts of 5 – 30% by weight of the carbon.

14. A process according to claim 1, wherein the carbon powder is charged in a can to form a canned carbon powder which is then subjected to the impregnation.

15. A process for the preparation of a carbon-metal composite material for sliding members, comprising impregnating carbon with an alloy consisting essentially of (a) a metal selected from the group consisting of copper, nickel, and copper-nickel alloys as a base metal; (b) at least one member selected from the group consisting of tin, manganese, antimony, and zinc; and (c) at least one member selected from the group consisting of titanium and zirconium as a wetting agent for the carbon.

16. A process for the preparation of a carbon-metal composite material for sliding members, comprising impregnating carbon with an alloy consisting essentially of (a) a metal selected from the group consisting of copper, nickel, and copper-nickel alloys as a base metal; (b) at least one member selected from the group consisting of tin, manganese, antimony, and zinc; (c) at least one member selected from the group consisting of iron, chromium, lead, magnesium, and phosphorus; and (d) at least one member selected from the group consisting of titanium and zirconium as a wetting agent for the carbon.

* * * * *